US008096560B2

(12) United States Patent
Pallini, Jr. et al.

(10) Patent No.: US 8,096,560 B2
(45) Date of Patent: Jan. 17, 2012

(54) METAL-TO-METAL SEAL FOR SMOOTH BORE

(75) Inventors: Joseph W. Pallini, Jr., Tomball, TX (US); Rockford D. Lyle, Pinehurst, TX (US); Chii-Ren Lin, Bellaire, TX (US)

(73) Assignee: Vetco Gray Inc., Houston, TX (US)

( * ) Notice: Subject to any disclaimer, the term of this patent is extended or adjusted under 35 U.S.C. 154(b) by 790 days.

(21) Appl. No.: 12/164,962

(22) Filed: Jun. 30, 2008

(65) Prior Publication Data

US 2009/0322029 A1 Dec. 31, 2009

(51) Int. Cl.
*F16L 21/02* (2006.01)
*F16L 17/08* (2006.01)

(52) U.S. Cl. ..... 277/607; 277/339; 277/608; 277/614; 277/615; 285/334.2; 285/341

(58) Field of Classification Search ..... 277/338, 277/339, 608, 614, 615, 607; 285/334.2, 285/341; 166/115, 116
See application file for complete search history.

(56) References Cited

U.S. PATENT DOCUMENTS 3,325,176 A * 6/1967 Latham et al. ..... 277/614
3,507,506 A * 4/1970 Tillman ..... 277/614
3,749,426 A * 7/1973 Tillman, III ..... 285/336
4,214,763 A * 7/1980 Latham ..... 277/614
4,410,186 A * 10/1983 Pierce, Jr. ..... 277/318
4,470,609 A * 9/1984 Poe ..... 285/334.2
4,471,965 A * 9/1984 Jennings et al. ..... 277/322
4,563,025 A * 1/1986 Poe ..... 285/334.2
4,930,791 A * 6/1990 Ungchusri et al. ..... 277/607
5,039,140 A * 8/1991 Szymczak ..... 285/334.2
5,058,906 A * 10/1991 Adamek et al. ..... 277/614
5,095,991 A 3/1992 Milberger
5,103,915 A * 4/1992 Sweeney et al. ..... 166/379
5,211,226 A 5/1993 Hendrickson et al.
5,464,063 A 11/1995 Boehm, Jr.
5,466,018 A * 11/1995 Stobbart ..... 285/334.2
5,839,765 A * 11/1998 Carter et al. ..... 285/334.2
6,450,507 B2 * 9/2002 Johnson ..... 277/612
6,561,521 B2 * 5/2003 Janoff et al. ..... 277/603
6,722,426 B2 * 4/2004 Sweeney et al. ..... 166/115
6,869,080 B2 * 3/2005 Janoff et al. ..... 277/603
7,819,439 B2 * 10/2010 Paton et al. ..... 285/341
2001/0045711 A1 11/2001 Johnson
2003/0000694 A1 * 1/2003 Sweeney et al. ..... 166/115
2004/0056432 A1 * 3/2004 Walker et al. ..... 277/627
2007/0013146 A1 * 1/2007 Gariepy ..... 277/608

OTHER PUBLICATIONS

International Search Report and Written Opinion, International Application No. PCT/US2009/048591, dated Oct. 16, 2009.

* cited by examiner

*Primary Examiner* — Alison Pickard
(74) *Attorney, Agent, or Firm* — Bracewell & Giuliani LLP

(57) ABSTRACT

A high pressure seal assembly configured for sealing contact with an opposing surface. The seal assembly comprises an annular seal body with a sealing surface on one side of the seal body. An end of the sealing surface includes a sealing face for sealing contact with the opposing surface. The sealing surface also includes at least one support point that contacts the opposing surface when the seal is placed in sealing contact. Strategically positioning the support point on the sealing surface selectively adjusts the sealing contact stress between the sealing face and the opposing surface.

15 Claims, 4 Drawing Sheets

METAL-TO-METAL SEAL FOR SMOOTH BORE

FIELD OF THE INVENTION

This invention relates in general to subsea oil and gas well production, and in particular to a metal-to-metal seal for use in a tieback connector.

BACKGROUND OF THE INVENTION

Metal-to-metal scaling is commonly used in subsea hydrocarbon production assemblies. For example, subsea wells typically have a subsea wellhead assembly at the seafloor with a subsea production tree mounted on the wellhead assembly. The tree has valves connected to flowlines for controlling flow from the well. In another type of installation, a string of tieback conduit extends from the subsea wellhead assembly to a platform at the surface. A surface tree is mounted on the upper end of the tieback conduit. Some riser systems have inner and outer tieback conduits, each of which is run separately and connected by a tieback connector. The inner and outer tieback conduits make up the tieback riser in that type of system.

The inner tieback conduit is installed by connecting a tieback connector to the lower end of the conduit and lowering it into the bore of the subsea wellhead housing assembly. The tieback connector has a locking member that locks to the subsea wellhead housing or to the tapered stress joint at the bottom of the outer tieback conduit. The inner tieback connector also includes a seal between where the tieback connector lands onto the subsea wellhead assembly. The seal is preferably a metal-to-metal seal, and it seals to an internal component of the subsea wellhead housing assembly. Metal-to-metal seals have a variety of configurations. While many work well, improvements are desired.

SUMMARY OF THE INVENTION

The seal assembly includes an annular metal seal body having oppositely extending legs. The legs extend from the seal mid-portion and have a sealing area on the ends of the legs. The sealing area is in sealing contact with a seal surface. Each leg includes at least one support between the leg end and the mid-section. Curved recesses are located above and below each support area, effectively reducing the thickness of each seal leg. The sealing force between the seal and the sealing surface is largely absorbed by the sealing area and the support. The support dimensions and location are adjustable, thus controlling the force applied to the sealing area.

The seat assembly can also include a web member extending from the mid-portion and perpendicular to the seal axis. The web member has a top and bottom surface aligned oblique to one another. The seal assembly can be used in tubular wellhead assemblies, including subsea assemblies. In one example, the seal assembly is used in conjunction with a junction between a tie-back connector and a subsea wellhead assembly.

DETAILED DESCRIPTION OF THE INVENTION

Figure 1:
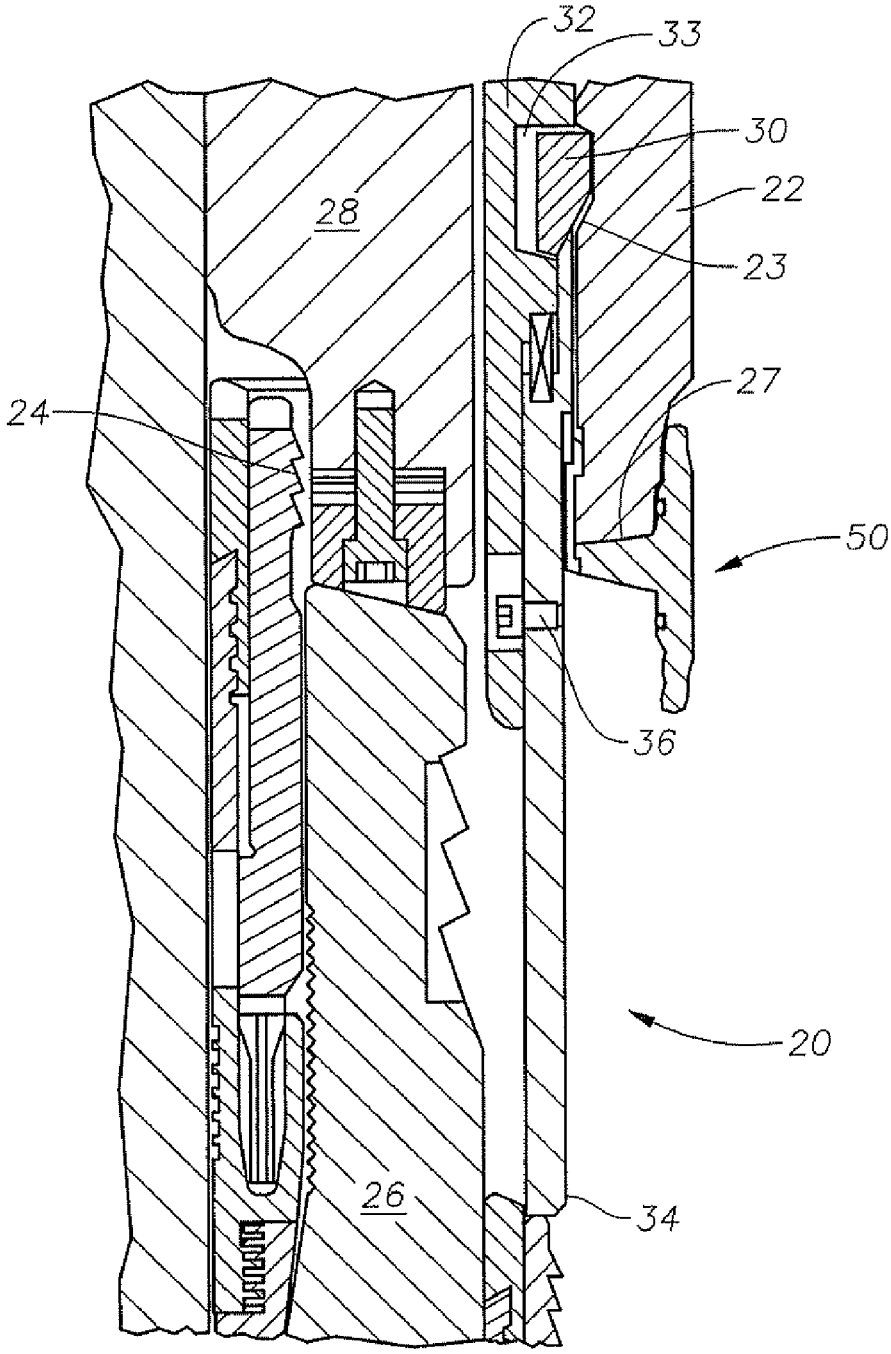
FIG. 1 is a sectional view illustrating a tieback connector, having a seal assembly, landing on a wellhead assembly.

Referring to FIG. 1, a tieback connector 20 for a subsea wellhead is illustrated in side cross-sectional view landing to a wellhead housing (not shown). The tieback connector 20 comprises an annular mandrel 22, an actuator sleeve 34 circumscribing the mandrel 22 lower portion, a sleeve 32 formed around both the upper portion of the actuator sleeve 34 and the mandrel 22, and a casing hanger lockdown member 28 coaxially circling the sleeve 32. Opposing mating surfaces of the mandrel 22 and the sleeve 32 respectively include a mandrel groove 23 and a sleeve groove 33. As shown, these grooves 23, 33 are aligned with a split ring 30 extending into both the mandrel groove 23 and the sleeve groove 33. The mandrel 22 and the sleeve 32 are coaxially coupled by the presence of the split ring 30 within the grooves 23, 33.

Figure 2:
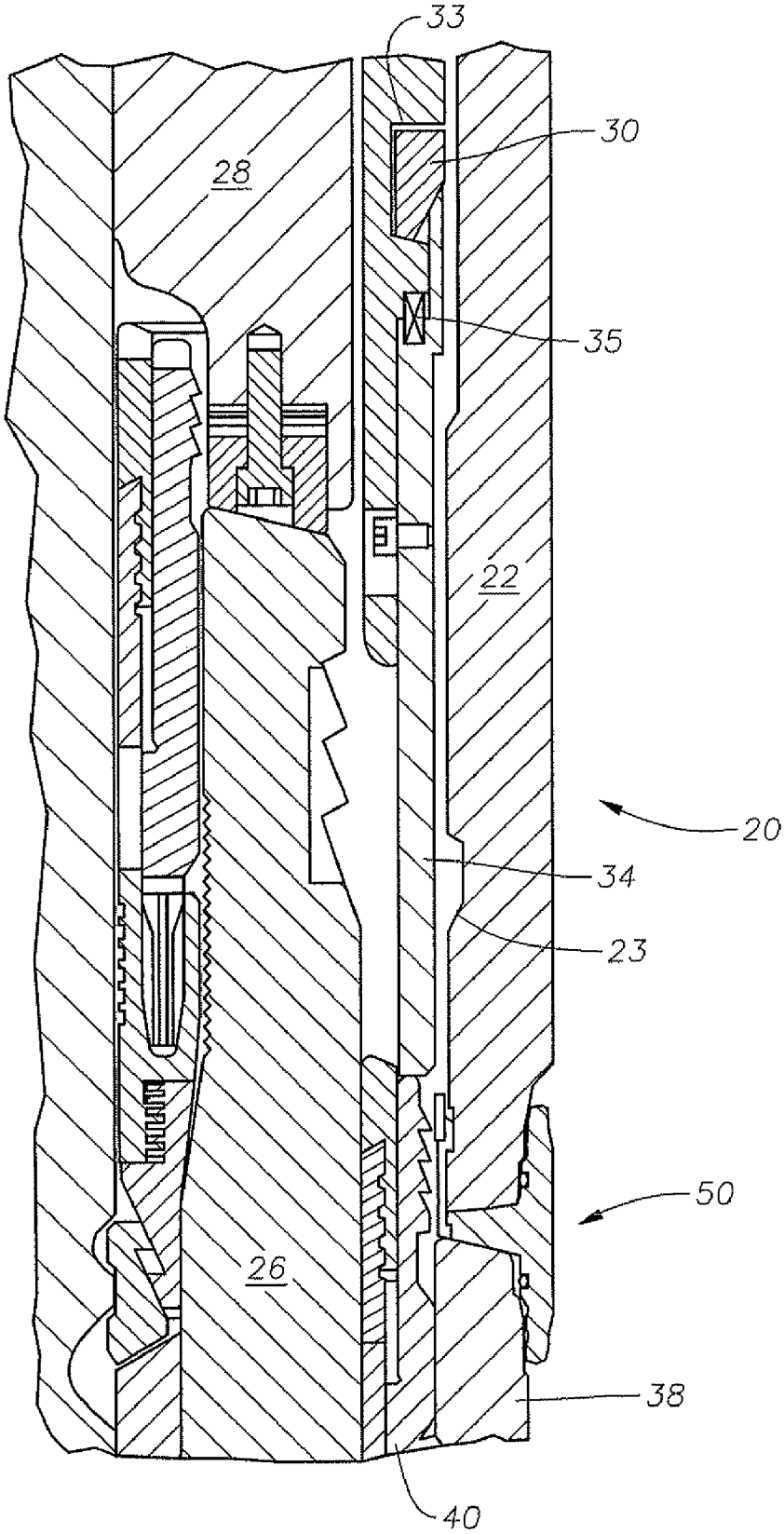
FIG. 2 is a sectional view illustrating the tieback connector of FIG. 1 in a landed position.
Figure 3:
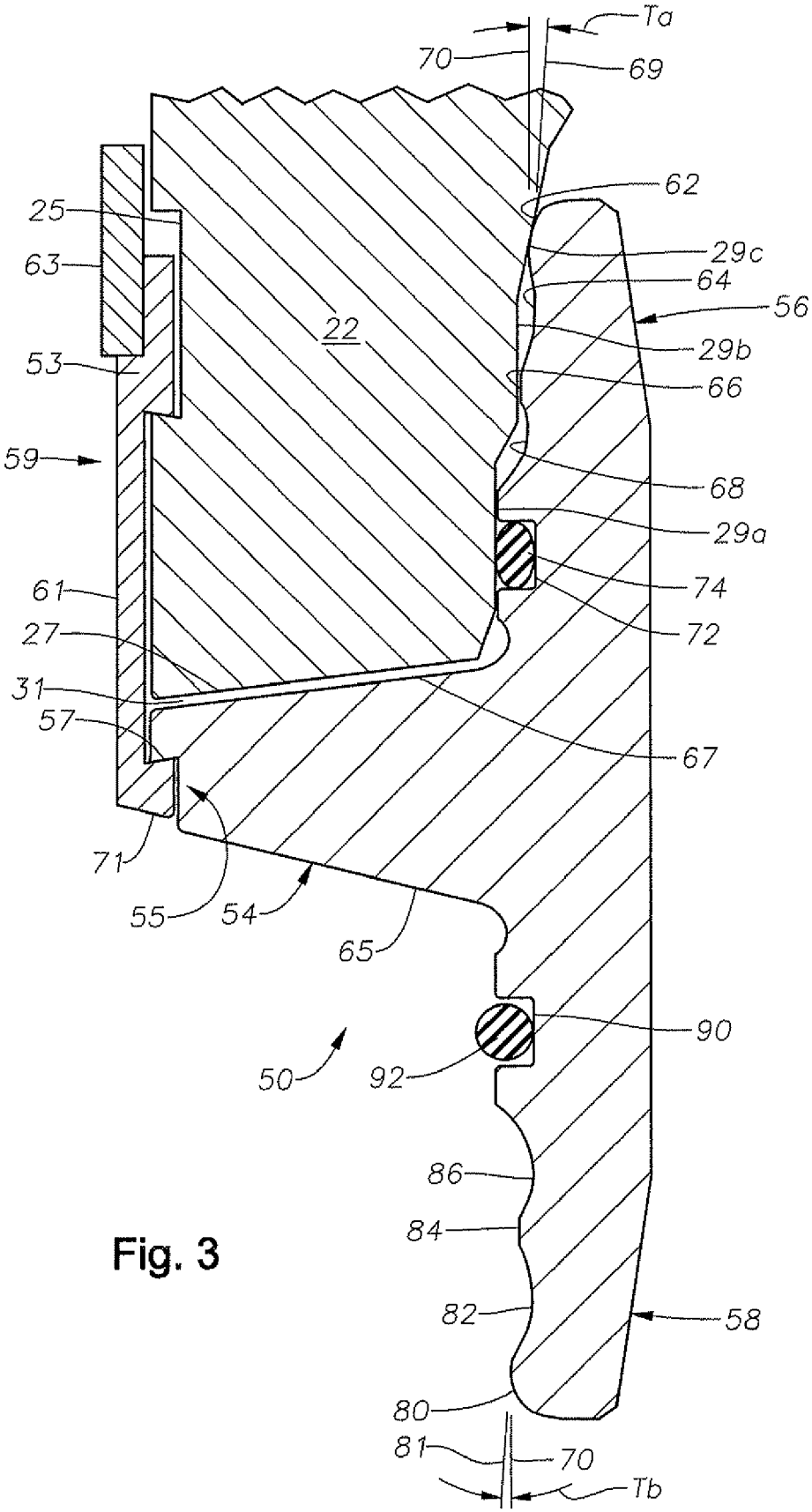
FIG. 3 is an enlarged sectional view of the seal assembly of FIG. 1.
Figure 4:
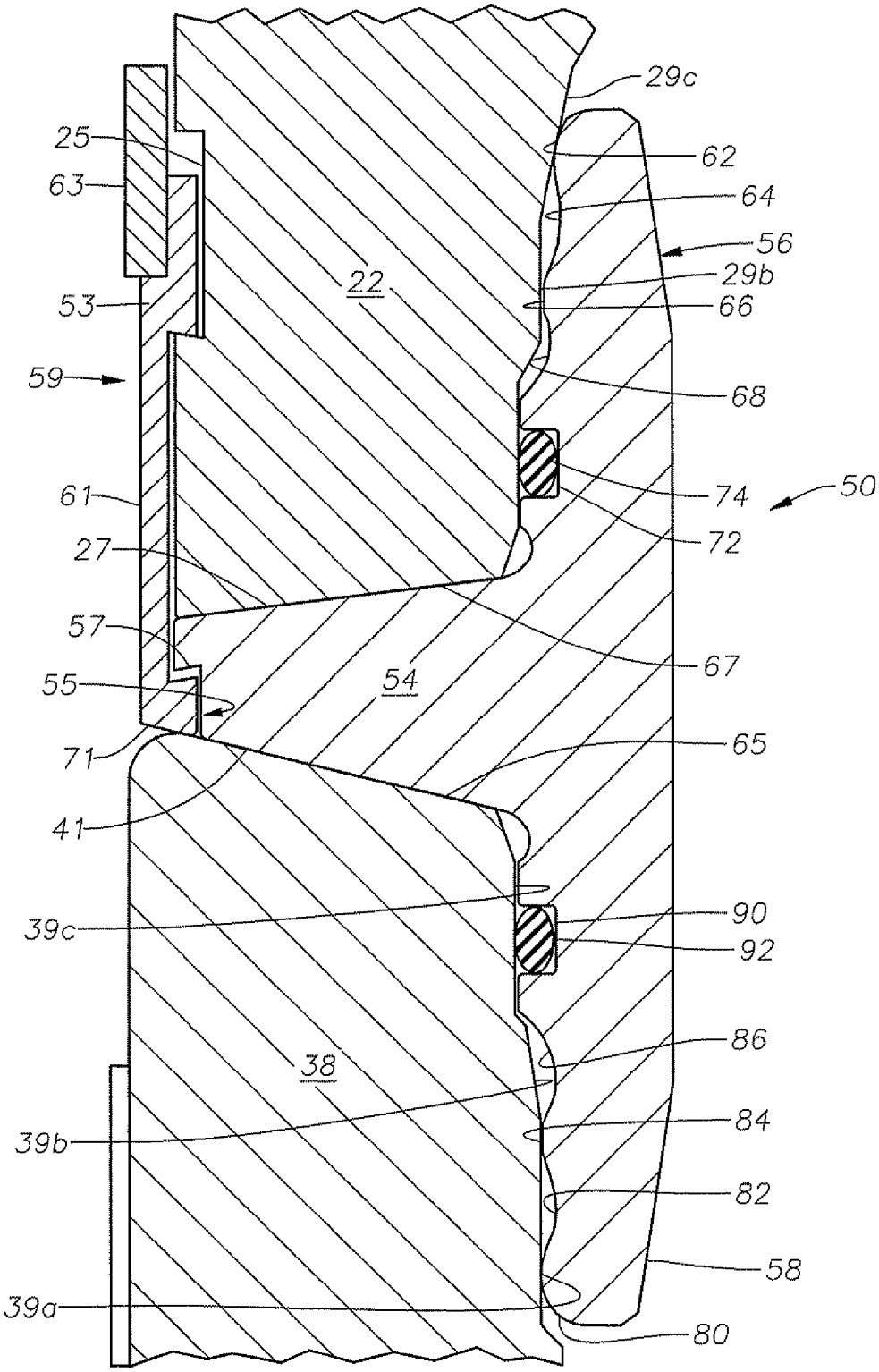
FIG. 4 is an enlarged sectional view of the seal assembly of FIG. 2.

The tieback connector 20 further includes a seal assembly 50 affixed to the lower end of the mandrel 22. FIGS. 1 and 3 illustrate seal 50 prior to energizing the seal 50. FIGS. 2 and 4 depict seal 50 in engagement with a casing hanger 38. With reference now to FIG. 3, an enlarged side cross-sectional view of the seal assembly 50 is illustrated. The seal assembly 50 comprises a metal seal member that may have an annular rib, base or web 54 on its outer side extending radially outward from its mid section and an upper leg 56 extending from the midsection substantially perpendicular to the web 54. Optionally included is a lower leg 58 extending in an opposite direction from the upper leg 56. An outer surface of the upper leg 56 has portions in sealing contact with a lower terminal end of the mandrel 22. Although the mandrel 22 is shown as a part of the tieback connection 20, the seal assembly 50 can be coupled with any annular member and used for sealing there between.

Mandrel 22 of FIG. 1 has a lower cylindrical sealing surface 29*a*, a central cylindrical or slightly conical support surface 29*b* and an upper conical sealing surface 29*c*. Lower cylindrical sealing surface 29*a* has a diameter larger than central cylindrical support surface 29*b* and is separated by a conical transition area. Upper conical sealing surface 29*c* has a maximum diameter at its junction with support surface 29*b*.

Seal 50 is an annular member circumscribing a longitudinal axis of mandrel 22. An upper leg seal groove 72 is optionally formed on a cylindrical lower portion of the upper leg outer surface proximate to the web 54. An elastomeric seal 74, located in seal groove 72, is shown in cross-section and elastically deformed when pressed against lower cylindrical sealing portion 29*a* of the opposing sealing surface 29 of the mandrel 22. An undercut or recess 68 is formed into the upper leg outer surface beginning a short distance above groove 74. Recess 68 begins at a portion of seal 50 that may be considered to be part of a base of first leg 56. The undercut 68 preferably has a generally circular profile terminating at a support area 66; the support area 66 may be cylindrical and has a finite axially dimension or thickness. Support area 66 may contact but does not necessarily seal to mandrel central support surface 29*b*. Support area 66 exerts less force against upper tubular member 22 than sealing area 62. The support area 66 axial thickness is less than the axial length of the undercut 68.

A second upper leg undercut or recess 64 is formed in the upper leg 56. Undercut 64 begins at support area 66 and terminates at an upper leg outer sealing area 62. The sealing area 62 is formed proximate the tip of the upper leg 56, and as will be described below, provides a primary point of sealing contact between the seal assembly 50 and the mandrel 22 upper conical sealing area 29*c*. Undercut 64 is shown as having a larger radius and axial length than undercut 68, but variations are possible.

In the embodiment of FIG. 3, sealing area 62 has a curved generally conical cross-section, but other configurations are feasible. The diameter of the sealing area 62 is less than the support area 66 diameter. The axial dimension or length of undercut 64 is greater than the contacting portion of upper seal 62. The axial length of sealing area 62, which is the portion that contacts and seals against mandrel surface 29*c*, ranges from about 10% to about 50% of the first recess axial length.

Upper leg 56 deflects elastically when being installed on mandrel 22, with sealing area 62 deflecting radially inward slightly to form a metal-to-metal seal with sealing surface 29*c*. Support area 66 preferably deflects a very small amount compared to the deflection of sealing area 62. Prior to being installed on mandrel 22, a line 69 tangent to seal area 62 and support area 66 would be a small positive angle Ta relative to a vertical line 70 parallel with the axis of mandrel 22. After installation the taper angle Ta between lines 69 and 70 increases slightly. Prior to installation, taper angle Ta may be from about 8° to about 15'.

The embodiment of the lower leg 58 of FIG. 3 is similar to the upper leg 56 but some differences do exist in the embodiments shown. Lower leg 58 will sealingly engage a sealing surface in casing hanger 38. As shown in FIG. 4, the sealing area in casing hanger 38 includes a lower cylindrical surface 38*a*, a conical transition area 39*b* and an upper cylindrical surface 39*c*. Upper cylindrical surface 39*c* is larger in diameter than lower cylindrical surface 39*a*. Upper cylindrical surface 39*c* and lower cylindrical surface 38*a* could be slightly conical, if desired.

The lower leg 58 optionally includes a cylindrical portion on its outer surface with a base portion having a seal groove 90 and an elastomeric O-ring seal 92 that seals to upper cylindrical surface 39*c*. The lower leg 58 also includes third and fourth recesses or undercuts 82, 86 separated by a support area 84. Recess 86 begins at what may be considered to be part of the base of second leg 58. Support area 84 may contact but does not necessarily seal to lower cylindrical surface 39*a*. Support area 84 exerts less force against casing hanger 38 than second sealing area 80. In this example, the lower undercut 82 and the upper undercut 84 have about the same axial lengths and radii, but the lower undercut 82 is shallower. Sealing area 80 on the lower leg 58 is proximate to the lower leg tip and optionally may have a rounded cross-section. Sealing area 80 sealingly engages casing hanger cylindrical surface 39*a*. The axial length of each undercut 82, 84 is greater than the axial thickness of support section 84 and the axial length of the contacting portion of sealing area 80.

One of the differences between the lower leg 58 and the upper leg 56 is the difference between the initial upper taper angle Ta and a lower taper angle Tb. Lower taper angle Tb is the initial angle, prior to installation, between a tangent line 81 and vertical line 70, which is parallel with the axis of casing hanger 38. The tangent line 81 is tangent to support area 84 and lower sealing area 80. Lower taper angle Tb is a reverse taper relative to vertical line 70 from upper taper angle Ta. Sealing area 80 has an outer diameter slightly greater than the diameter of casing hanger cylindrical surface 39*a*. When sealing area 80 is forced against casing hanger cylindrical surface 39*a*, lower leg 58 elastically deflects inward, thereby decreasing taper angle Tb. Angle Tb decreases during installation, and prior to installation is preferably no greater than about 2 degrees.

The web 54 has a generally frusto-conical cross section, its width decreasing from the body 52 mid section to the web 54 crown 55. The crown 55 outer surface is profiled to form a ridge 57 along the crown's 55 outer circumference in this example. In this embodiment, the web 54 upper surface 67 and lower surface 65 are not parallel. These surfaces 65, 67 may have the same angle with respect to the axis of seal 50, or can have different angles as shown. In another embodiment, the surfaces 65, 67 may be generally parallel with each other, resulting in a near uniform thickness of rib 54. A retainer assembly 59 engages the ridge 57 for retaining the seal assembly 50 on the lower end of the mandrel 22. The retainer assembly 59 comprises a clip 61 having an elongated body with an inwardly protruding lip 71 on its lower end. The lip 71 mates with the ridge 57 and supports the seal assembly 50 on the mandrel 22. At this stage the seal assembly 50 is only partially in sealing engagement with the mandrel 22, thus a gap 31 remains between the mandrel 22 lower terminal surface 27 and the web 54 upper surface 67. The upper end of the clip 61 includes a base 53 wedged into a channel 25 formed on the mandrel 22 outer radial surface. An annular ring 63 circumscribes the outer portion of the base 53 for slidingly retaining it within the channel 25. Other retainers are feasible.

With reference now to FIG. 2, the tieback connector 20 is shown landed on the wellhead housing and in contact with inner or second casing hangar 38. The seal assembly 50 is wedged between the lower terminal end 27 (FIG. 4) of the mandrel 22 and the upper terminal end 41 of the second casing hangar 38. In this embodiment the mandrel 22 has been uncoupled from the sleeve 32 and traveled downward with respect to the sleeve 32. Uncoupling the sleeve 32 from the mandrel 22 involves using the activation sleeve 34 to urge the split ring 30 into an open space at the back end of the recess 33. The activation sleeve 34 upper end engages a profiled portion on the split ring 30 lower end to slide it out of the mandrel groove 23 permitting axial sliding of the mandrel 22 with respect to the sleeve 32. Alternatively, mandrel 22 could have a threaded engagement with sleeve 32 that causes it to move between the portion of FIG. 1 and the portion of FIG. 2 by rotation of the mandrel 22.

An enlarged view of the seal assembly 50 wedged between the mandrel 22 and the casing hangar 38 is provided in a cross-sectional view in FIG. 4. During landing, lower seal leg 58 will stab into casing hanger cylindrical portion 38*a* with straight downward movement. Seal area 80 elastically deflects and forms a sealing engagement with cylindrical portion 38*a*. Then, in this example, the operator rotates mandrel 22, which will rotate relative to seal 50. The rotation causes mandrel 22 to advance downward slightly relative to seal 50, causing gap 31 to close as mandrel lower surface 27 contacts web 54 upper surface 67. The downward movement of mandrel 22 also engages the upper leg sealing area 62 with mandrel sealing surface 29*c*. This engagement bends the upper leg 56 elastically toward the axis, thereby forming a stress area between the seal area 62 and the sealing surface 29*c* to energize the seal assembly 50.

Internal pressure acts against seal 50 to apply an internal force on seal areas 62 and 80, which is reacted by casing hanger seal surface 39*a* and mandrel sealing surface 29*c*. Internal pressure may also cause support areas 66 and 84 to contact mandrel surface 29*b* and casing surface 39*a*, respectively. This contact is not necessarily a sealing contact, however, and is less than the forces imposed by the sealing areas. Strategically positioning the support area 66 on the sealing surface, in combination with the curved undercuts 64, 68, provides a means for controlling the sealing stress value between the sealing area 62 and the sealing surface 29*c* when energizing the seal assembly 50. A significant increase in sealing stress is achievable using the control means, wherein the maximum sealing stress is maintained below the yield point of the respective materials of the mandrel 22 and the seal 50. Additionally, controlling the stress at the sealing area 62 also insures other high stress points in the seal 50 will not exceed their respective yield values. The support areas 66 and 84 provide stiffening of legs 56, 68 against internal pressure loads. It is well within the capabilities of those skilled in the art to form seal legs having appropriately dimensioned undercuts, supports, and seal areas to achieve the desired results described herein.

The angled upper and lower surfaces 67, 65 of the web 54 comprise an additional feature of the seal assembly 50. The corresponding lower terminal end 27 of the mandrel 22 and the upper terminal end 41 of the casing hangar 38 are correspondingly angled to match the upper and lower surface contours. A lateral force exerted to the exterior of either the mandrel 22 or the casing hangar 38 is transferred to the other annular member via the wedge shaped web 54. This force transfer effectively couples the members together, thereby resisting lateral movement of one member with respect to the other.

While the invention has been shown in a single form, it should be apparent to those skilled in the art that it is not so limited but susceptible to various changes without departing from the scope of the invention. The upper lower seal leg could be mounted to a seal ring having a considerably different upper seal leg than shown, and vice-versa. For example, in the embodiment shown, the upper seal leg is configured to allow rotation between the mandrel and the upper seal leg prior to full setting, but this not need be the case. A seal with only a single seal leg and no rib or web is also feasible, particularly if the seal is formed as a lip on a sleeve. The clip for retaining the seal member during deployment could be replaced with a threaded fastener.

The invention claimed is:

1. A seal assembly for sealing to a tubular member, comprising:

an annular metal seal body having a leg with a base and a tip;

a sealing area on an outer surface of the leg proximate to the tip for sealing engagement with a tubular member;

a support area on the outer surface between the base and the sealing area, the support area configured to contact the tubular member but exert less force against the tubular member than the sealing area exerts against the tubular member;

a first recess formed on the outer surface of the leg and extending from the support area to the sealing area;

a cylindrical portion on the outer surface of the leg proximate the base and having a seal groove containing an elastomeric seal ring; and a second recess formed on the outer surface of the leg between the cylindrical portion and the support area, wherein the first recess has a length, measured along an axis of the seal body, that exceeds a length of the sealing area.

2. The seal assembly of claim 1, wherein the second recess has a length that exceeds the length of the sealing area.

3. The seal assembly of claim 1, wherein the sealing area on the leg has a taper angle measured between a line tangent to the sealing area and the support area relative to a line parallel to the axis of the seal that is from about 8° to about 15°.

4. The seal assembly of claim 3 further comprising:

a second leg extending from the base in an opposite direction to the first leg and having a tip with a sealing area on an outer surface proximate the tip of the second leg for sealing engagement with a second tubular member;

a support area on the outer surface of the second leg between the base and the sealing area of the second leg for contact with the second tubular member, the support area of the second leg configured to contact the second tubular member but exert less force against the second tubular member than the sealing area of the second leg exerts against the second tubular member;

a third recess on the outer surface of the second leg and extending from the base to the support area on the second leg; and a fourth recess on the outer surface of the second leg and extending from the support area on the second leg to the sealing area on the second leg.

5. The seal assembly of claim 4, wherein the sealing area on the second leg has a taper angle measured between a line tangent to the sealing area and the support area on the second leg relative to a line parallel to the axis of the seal that is not greater than 2° and is in reverse to the taper angle of the first leg.

6. The seal assembly of claim 1, wherein the sealing area is curved.

7. A seal assembly comprising:

an annular metal seal circumscribing an axis, the seal having a middle portion and first and second legs extending in opposite directions from the middle portion; and a web member extending from the middle portion perpendicular to the axis, the web member terminating at a web tip and having upper and lower sides, wherein the sides are disposed oblique to the axis and converge towards one another with distance away from the middle portion;

a sealing area proximate to a tip of the first leg; and a support area on the first leg outer surface between the middle portion and the sealing area.

8. The seal assembly of claim 7, wherein the angle between the upper side and the axis differs from the angle between the lower side and the axis.

9. The seal assembly of claim 7 further comprising:

a first recess formed on the first leg outer surface from the support area to the sealing area.

10. In a subsea well apparatus having first and second tubular members, each having a bore, the first and second tubular members being in end-to-end abutment, an improved seal assembly that seals between the first and second tubular members, comprising:

an annular metal seal body having a middle portion and first and second legs extending in opposite directions from the middle portion, the seal body circumscribing an axis;

a first sealing area on an outer surface of the first leg proximate to a tip of the first leg and in sealing engagement with a conical portion of the bore of the first tubular member;

a second sealing area on an outer surface of the second leg proximate to a tip of the second leg and in sealing engagement with a cylindrical portion of the bore of the second tubular member;

a first support area on the first leg outer surface between the middle portion and the first leg sealing area and in contact with the bore of the first tubular member, the first support area exerting less force against the first tubular member than the first sealing area;

a second support area on the second leg outer surface between the middle portion and the second leg sealing area and in contact with the bore of the second tubular member, the second support area exerting less force against the second tubular member than the second sealing area;

a first recess formed on the first leg outer surface from the first support area to the first sealing area;

a second recess formed on the first leg outer surface from the support area to the middle portion, wherein the first recess has an axial length, measured along the axis of the seal body, that exceeds an axial length of a contact area of the first sealing area;

a third recess formed on the second leg outer surface from the second support area to the second sealing area; and a fourth recess formed on the second leg outer surface from the second support area to the middle portion, wherein the fourth recess has an axial length, measured along the axis of the seal body, that exceeds an axial length of a contact area of the second sealing area.

11. The subsea well apparatus of claim 10, further comprising a web extending radially outward from the middle portion of the seal body, the web having a first side that is engaged by an end of the first tubular member and a second side that is engaged by an end of the second tubular member, and wherein the first and second sides are disposed oblique to the axis.

12. The subsea well apparatus of claim 10, wherein the first recess and the second recess each has an axial length that exceeds an axial length of the first support area.

13. The subsea well apparatus of claim 10 further comprising:

wherein the third recess and the fourth recess each has an axial length that exceeds an axial length of the second support area.

14. The subsea well apparatus of claim 10, wherein the sealing area on the first leg has a taper angle measured between a line tangent to the sealing area and the support area on the first leg relative to a line parallel to the axis of the seal body;

the sealing area on the second leg has a taper angle measured between a line tangent to the sealing area and support area on the second leg relative to a line parallel to the axis of the seal that is in reverse to the taper angle on the first leg; and the amount of the taper angle of the second leg is less than the amount of the taper angle of the first leg.

15. The subsea well apparatus of claim 10, wherein the first tubular member is rotatable relative to the seal assembly after engaging the lower tubular member and while energizing the seal.

* * * * *